United States Patent [19]

Hasenbalg

[11] Patent Number: 4,543,000

[45] **Date of Patent: * Sep. 24, 1985**

[54] LATCHING ACTUATOR

[76] Inventor: Ralph D. Hasenbalg, 8635 Rudnick Ave., Canoga Park, Calif. 91304

[ * ] Notice: The portion of the term of this patent subsequent to Apr. 10, 2001 has been disclaimed.

[21] Appl. No.: 556,836

[22] Filed: Dec. 1, 1983

Related U.S. Application Data

[63] Continuation-in-part of Ser. No. 310,850, Oct. 13, 1981, Pat. No. 4,441,833.

[51] Int. Cl.[4] ..... B41J 23/22; F15B 15/26

[52] U.S. Cl. ..... 400/180; 92/24; 400/473

[58] Field of Search ..... 400/180, 181, 473, 474; 92/24, 27, 28

[56] References Cited

U.S. PATENT DOCUMENTS

| | | | |
|---|---|---|---|
| 859,843 | 7/1907 | Rogers | 92/24 |
| 2,908,251 | 10/1959 | Gratzmuller | 92/27 X |
| 3,398,651 | 8/1968 | Folmer | 92/27 |
| 4,441,833 | 10/1984 | Hasenbalg | 400/180 |

*Primary Examiner*—Paul T. Sewell

*Attorney, Agent, or Firm*—Lyon & Lyon

[57] ABSTRACT

A keyboard actuator for actuating the keys of a keyboard-operated apparatus including a plurality of fluid latching actuators supported to controllably and selectively actuate a key. In the preferred embodiment, each fluid actuator includes a latch and a piston. In response to fluid pressure, the latch releases the piston and the piston may be driven to actuate a key of the keyboard-operated apparatus. No return spring is used to cause a piston rod to rise to a position where it can be latched. The upward action of normally operative key effects the return of the piston rod to achieve latching.

6 Claims, 5 Drawing Figures

LATCHING ACTUATOR

RELATED APPLICATION

This application is a continuation-in-part of U.S. Ser. No. 310,850, now U.S. Pat. No. 4,441,833 filed Oct. 13, 1981, the contents of which are incorporated by reference herein.

BACKGROUND OF THE INVENTION

This invention relates generally to computer peripheral devices and more particularly to a latching actuator for use in actuating the keys of a keyboard in response to control signals which may be computer generated. In particular the latching actuator is fluid actuated.

As the use of computers and microprocessors continues to increase the types and configurations of keyboards associated therewith has also continued to expand. These keyboards include not only the well-known typewriter-like keyboard, but also keypads for numeric or control function input and special purpose keyboards as found in point-of-sale terminals.

With the increasing use of keyboards, there also arises a corresponding need to test the keyboards thoroughly. Although such tests can be done manually, testing of this nature can be time consuming and thus expensive. Moreover, manual testing presents the possibility that conducting the test may not accurately follow the test routine, resulting in keyboards that are not fully tested. Also, where the durability of a keyboard is to be tested by repeated actuation of the keys, manual testing is impractical because of the length of time required to complete such tests.

Therefore, there is a need for a keyboard actuator assembly which can efficiently and effectively test various types of keyboards. It is further desirable that such a keyboard actuator assembly be able to test a keyboard quickly and that the actuator assembly be reliable and operable for long periods of time. Also, it is advantageous that such an actuator assembly be relatively simple and mechanically sturdy to increase its reliability.

Another need is for a latching fluid actuator which is effectively simple in construction, highly responsive to the keys and with a minimum number of parts.

SUMMARY OF THE INVENTION

The latching fluid actuator and keyboard actuator assembly of the present invention overcome the limitations and disadvantages described above, and provide a latching actuator and keyboard actuator assemblies that are effective, durable and reliable. The actuator is able to operate at relatively high speeds for sustained periods of time. The keyboard actuator assembly is adjustable to accommodate various keyboard configurations.

A latching fluid actuator in accordance with the present invention provides a latching function in an unexpectedly simple device which can be, for example, injection molded. The embodiment of the fluid actuator disclosed herein can include a piston having a rod and a latch element with a first member and a second member disposed on opposite sides of the piston rod. A third member of the latch element interconnects the first member and the second member. The piston rod includes engagement means such as a notch. A spring biases the first member of the latch element into engagement with the engagement means. A relatively simple fluid responsive member such as a diaphragm operates the second member of the latch element against the biasing force of the spring to unlatch the piston. The piston is then free to move under fluid pressure.

There is no return spring to cause the piston rod to return to its position prior to activating the key. The pressure of a normally operative key active upwardly against the weight of the rod and its concomitant parts is sufficient to return the piston to its position. This permits for a particularly simple latch construction with less components than had previously been thought possible.

The keyboard actuator assembly disclosed herein includes a frame and a plurality of fluid latching actuators. The fluid latching actuators are supported by support members and are adapted to be associated with respective keys of a keyboard-operated apparatus. A first plurality of fluid conduits is in communication with one or more selected fluid actuators. Also, a second plurality of fluid conduits is in communication with one or more selected actuators, each of the fluid actuators being responsive to one of the first plurality of fluid conduits and one of the second plurality of fluid conduits. The fluid pressure in the selected ones of the first and second pluralities of fluid conduits causes latch means in a fluid actuator to unlatch and piston means in the fluid actuator to operate a key of the keyboard associated with the particular actuator.

The latching fluid actuator advantageously allows the keyboard actuator to be operated in response to fluid pressure, thus minimizing the number of moving or sliding components and elements to thereby decrease overall complexity and increase reliability. Furthermore, the fluid actuator, by including both latching means and piston means, performs a function similar to a logic AND, that is, the piston means does not move unless both drive fluid pressure and latch release fluid pressure are applied to the fluid actuator. This enables the fluid actuators to be arranged in the keyboard actuator assembly as a matrix of rows and columns each controlled by a fluid valve.

DETAILED DESCRIPTION

Figure 1:
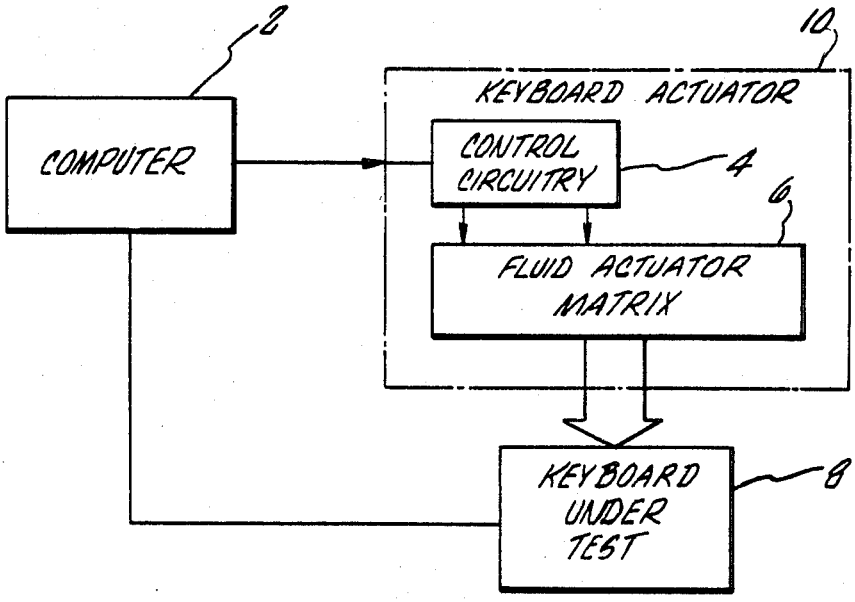
FIG. 1 is a block diagram of a system which can utilize a keyboard actuator assembly in accordance with the present invention.

An overall system which may utilize a keyboard actuator assembly in accordance with the present invention is shown in FIG. 1. A computer 2 provides coded signals to a keyboard actuator assembly 10. Control circuitry 4 within the actuator assembly 10 receives the coded signals and encodes the signals to operate a fluid actuator matrix 6. The matrix 6 in turn drives a keyboard under test 8 by actuating the keys thereof. An output from the keyboard under test 8 to the computer 2 provides an indication of keyboard performance which is used to detect errors in keyboard operation.

Figure 2:
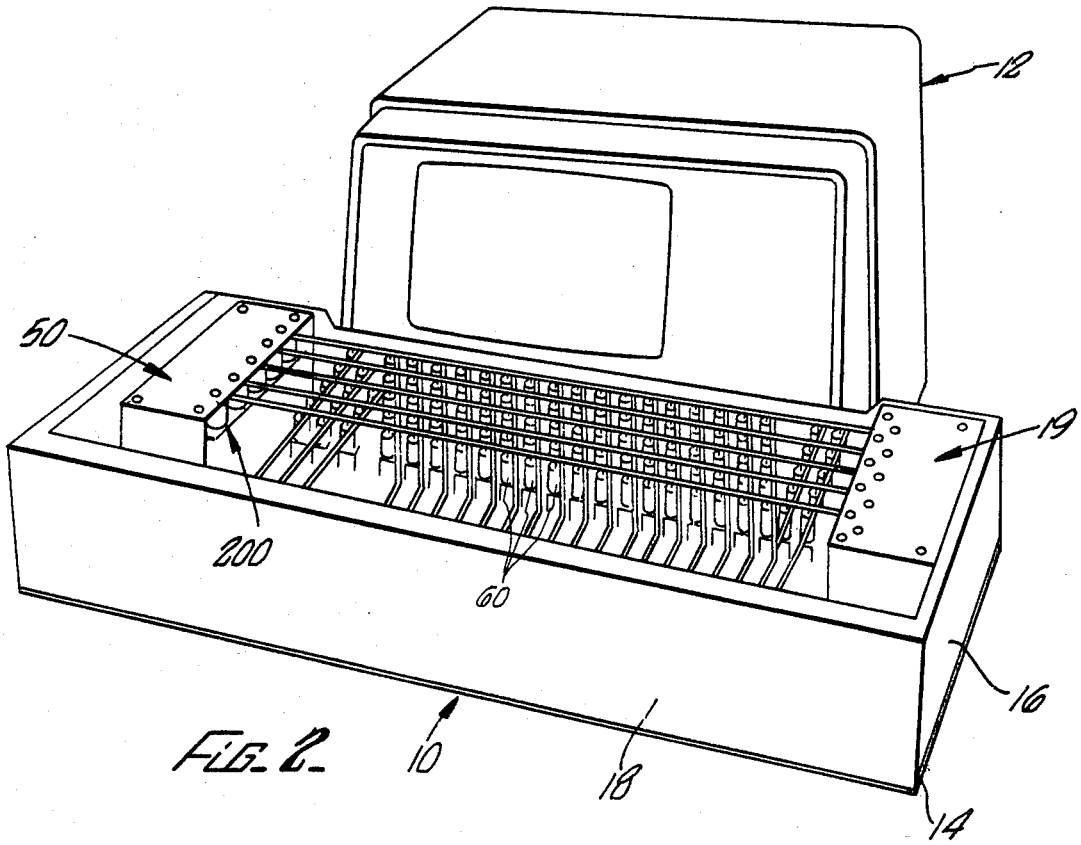
FIG. 2 is a perspective view of a keyboard actuator assembly in accordance with the present invention.

With reference now to FIG. 2, the keyboard actuator assembly 10 is adapted to be positioned over the keyboard under test of, for example, a computer terminal 12. The keyboard actuator assembly 10 has a bottom plate 14 to which are fixed three side panels, two of which are designated 16 and 18 in FIG. 2. The third side panel is opposite the panel 16. The keyboard actuator 10 is opened at the side opposite the side panel 18 to receive the keyboard of the terminal 12.

Actuator support and adjustment mechanisms 19 and 50 are disposed at opposite ends of the keyboard actuator assembly 10.

The mechanisms 19 and 50 allow complete adjustment so as to be adapted to the particular physical configuration of a variety of keyboards. The adjustments can be easily performed and can be changed repeatedly without degrading the performance of the keyboard actuator 10.

Spacing between adjacent ones of the actuators 60 is adjusted to conform to the spacing between the keys of the keyboard over which the keyboard actuator assembly 10 is adapted to be placed.

Figure 5:
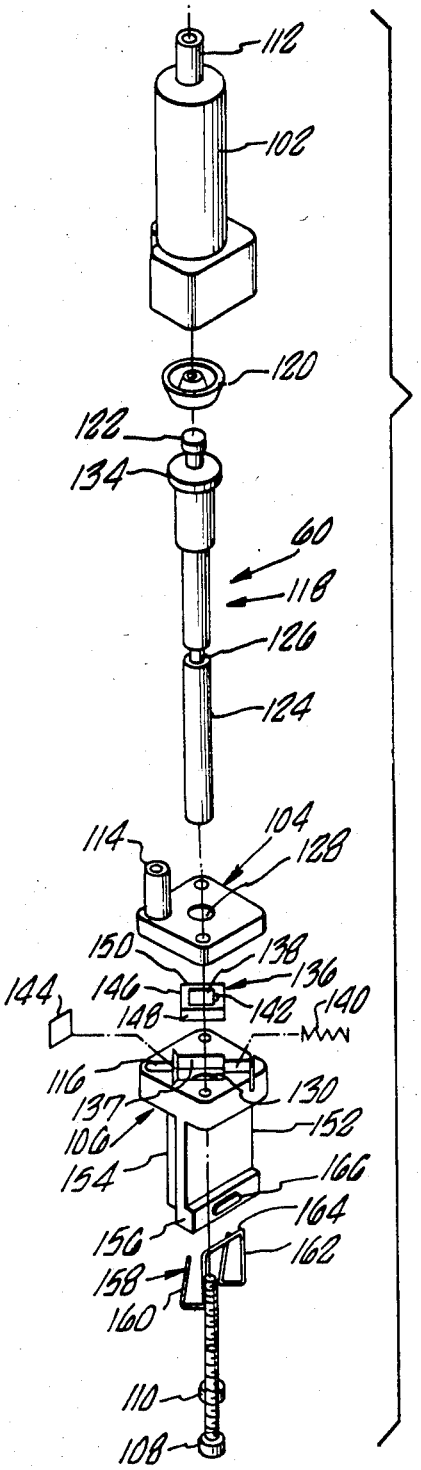
FIG. 5 is an exploded view of the latching fluid actuator of FIGS. 3 and 4.
Figure 3:
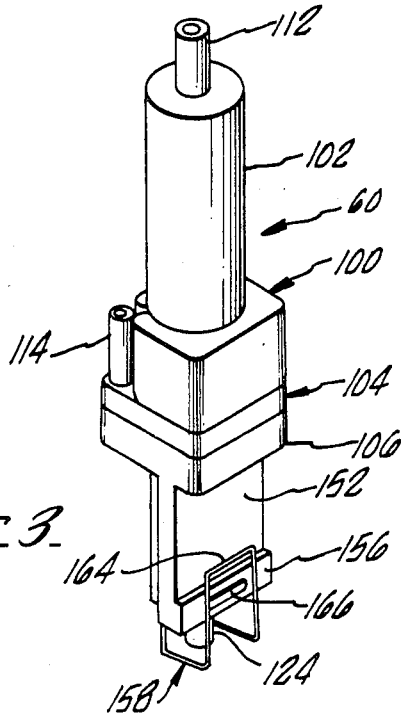
FIG. 3 is an exterior view of a latching fluid actuator used in the keyboard actuator assembly of FIG. 2.
Figure 4:
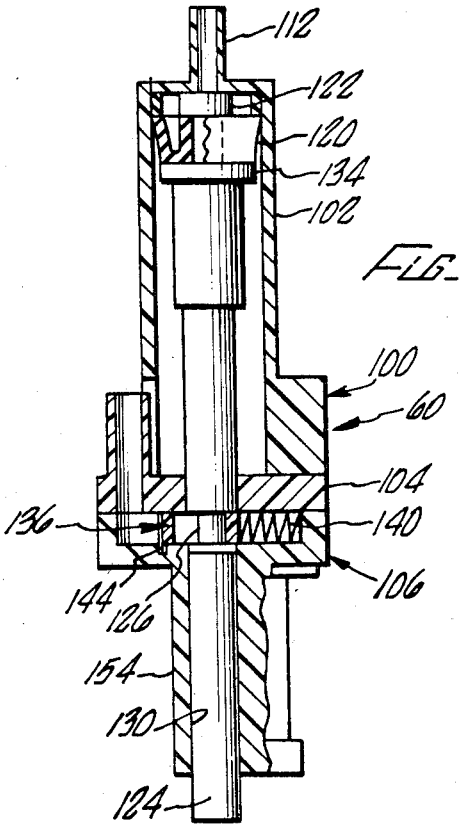
FIG. 4 is a cut away view of the latching fluid actuator of FIG. 3.

In FIGS. 3 to 5, there is shown the latching fluid actuator 60 which includes a housing 100 comprising a cylinder 102, a latch cover 104 and a base 106. Two self-tapping screws 108 and 110 hold the housing components together to form a completed actuator 60.

The cylinder 102 includes a drive fluid inlet 112 at the upper end thereof and the latch cover 104 includes a latch release fluid inlet 114. The drive fluid inlet 112 allows fluid communication into the cylinder 102 while the latch release fluid inlet 114 provides fluid communication through the latch cover 104 to a small chamber 116 in the base 106.

A piston 118 is carried within the cylinder 102. A U-cup seal 120 is fixed integrally or separately to a pin 122 at the top of the piston 118. The seal 120 provides a seal between the piston 118 and the inside surface of the cylinder 102. A piston rod 124 extends downwardly and includes an engagement means comprising a latch notch 126. As seen in FIGS. 3–5, the rod 124 extends through an opening 128 in the cover 104 and a second opening 130 in the actuator base 106.

There is no return spring to return the piston rod 124 between the cover 104 and a flange 134 at the upper end of the piston to bias the piston 118 upwardly. The upward action of the keys operating correctly, effectively achieves this. This provides for a particularly desirable and simple catch actuator.

A latch release means is carried between the cover 104 and the base 106. This latch release means includes a latch member 136 carried in a cavity 137. The latch member has an opening 138 through which is passed the rod 124. A latch return spring 140 acting against a first member 142 biases the latch element 136 toward the rod 124. A latch diaphragm 144 is carried in slots formed into the latch cover 104 and the base 106. One side of the diaphragm 144 is in communication with the chamber 116. The second side of the diaphragm 114 acts against a second member 146 of the latch element 136. Two side members 148 and 150 of the latch element 136 connect the first member 142 to the second member 146 and define the opening 138.

A flat mounting tongue 152 extends downwardly from the base 106. The tongue 152 includes a guide 154 for the piston rod 124. A lip 156 projects from the lower edge of the mounting tongue 152. A resilient clip 158 of bent spring wire is adapted to fit over the lip 156 and tongue 152. The clip 158 includes two generally U-shaped spring portions 160 and 162 and a joining member 164 which connects the portions 160 and 162 such that the portions 160 and 162 are parallel.

The mounting tongue 152 is adapted to receive one of the actuator support bars. The bar is received against the mounting tongue 152 between the base 106 and the lip 156. The clip 158 is initially installed onto the lip 156 such that the joining member 164 is above a projection 166 on the lip 156 to thereby retain the clip 158. Once the actuator 60 is installed on one of the support bars **52*a*–52*e*, the clip 158 is then moved upwardly to secure the actuator 60** to the support bar.

The operation of the latching fluid actuator 60 is now considered. With no fluid pressure applied to the actuator 60, the key being tested, if it is operating effectively and correctly, returns the piston 118 upwardly into the cylinder 102.

The latch actuator responds to the action of the key being tested without the need of an extra return spring. This renders the latching fluid actuator highly effective and simpler in construction than previously available latch actuators.

The piston rod of the preferred embodiment is made of a polyacetal resin commercially known as Delrin (Trademark of Dupont) or Celcon (Trademark of Celanese Corporation). This lightweight material ensures effective interaction of the key on the piston rod without the need for the return spring. For embodiments where the key is made of metal, its mass may be ten or more times heavier than its plastic counterpart, and although it can also work without a spring it may not be as effective and sensitive.

Once the notch 126 is aligned with the first member 142 of the latch element 136, the spring 140 urges the first member 142 into engagement with the notch 126. This latches the piston 118 in a retracted position. Fluid pressure may then be applied to the drive fluid inlet 112 but the piston 118 will not be displaced in response thereto.

However, with fluid pressure applied to the latch release fluid inlet 114, the latch diaphragm 114 drives the latch element 136 against the bias of the spring 140 to thereby unlatch the piston 118. The movement of the latch element 136 is restricted by the dimensioning of the cavity 137 which carries the latch element 136. With the piston 11 released, fluid pressure applied through the drive fluid inlet 112 can move the piston 118 downwardly, thereby extending the rod 124.

It is to be noted that fluid pressure applied to only one of the inlets, that is either the drive fluid inlet 112 or the latch release fluid inlet 114, does not cause displacement of the piston 118. Instead, fluid pressure must be applied to both of the inlets 112 and 114 in order to enable the movement of the piston 118. Moreover, it will be recognized that the fluid actuator 60 can be modified such that the latching of the piston will only be accomplished when fluid pressure is applied to the diaphragm 144. To accomplish this, the spring 140 is arranged to bias the latch element 136 into the unlatched position, that is, the first member 142 is not engaged with the notch 126. The diaphragm 144 is then arranged to act against the first member 142 so that when fluid pressure is applied to the diaphragm 142, the piston 118 will be latched when the first member 142 is aligned with and thus engages the notch 126. Also, the fluid actuator 60 can be adapted to latch the piston 118 in various positions, such as extended or down, by changing the location of the notch 126 along the piston rod 124.

Suitable electronic control circuitry 4 is used to actuate selected ones of the valves in the matrix 6. The type of control circuitry used is not critical.

It will also be apparent to those skilled in the art that the keyboard actuator assembly 10 of the present invention may be controlled by microprocessor-based circuitry. The microprocessor advantageously can be reprogrammed to vary functions and to define the operation of the keyboard actuator assembly 10.

The overall operation of the keyboard actuator assembly 10 may now be summarized. With reference to FIGS. 1 and 4, the computer 2 provides to the control circuitry of the keyboard actuator assembly 10 signals, such as an ASCII code. The control circuitry in turn decodes the input and controls the valves to apply fluid pressure from the supply manifold to the manifolds associated with the respective valves. One of the latching fluid actuators 60 thus receives both latch release fluid pressure and drive fluid pressure. Consequently, the latch element 136 of the selected fluid actuator 60 releases the piston 118 and the piston 118 is driven downwardly. The piston rod 124 can then contact a keyboard key to actuate the key.

As a specific example, the computer 2 may provide an ASCII code to the control circuitry 4 corresponding to a letter "g". The control circuitry 4 may then actuate the valves, applying fluid pressure to the manifolds. The pressure in one manifold is applied to all the fluid actuators 60 in a Y axis while the pressure in a different manifold actuates actuators in an X axis, the result being such that only one of the fluid actuators 60 receives both latch release fluid pressure and drive fluid pressure. Consequently, the piston 118 for that actuator 60 is driven to depress the key associated therewith. By properly adjusting the positions of the actuators 60, this key is the "g" key of the keyboard being tested.

Once the key is actuated, the control circuitry 4 removes the control signals from the valves. The valves remove fluid pressure from the associated manifolds and vent these manifolds to atmosphere to completely release all fluid pressure applied to the associated actuator 60.

A test procedure for the mechanical return of keys on a keyboard using the keyboard actuator and latching actuator of the invention would be generally as follows. In each step below it is understood that an appropriate delay, if needed, is allowed for each action to occur.

First, the actuator latch 60 for the key under test is retracted by pressurizing the relevant latch release manifold that includes the key. Second, the relevant drive manifold that includes the key under test is pressurized to push the key down with the desired force. Third, a first electrical output from the keyboard key under test is sampled to verify the down condition and then the relevant drive manifold is depressurized to allow the key to return to the up position. Fourth, the relevant latch release manifold is depressurized to allow the latch to return to the latched condition.

Should the key bind and not completely return, the latch will not be aligned with the latch ring 126 in the piston rod 124 and will not latch. It is the action of the upward force of the key which is normally sufficient to return the piston rod 124 upwardly to its retracted position. No spring is employed for this. Fifth, the relevant drive manifold is repressurized to apply a force to the piston 124. Finally, a second electrical key output is again tested for output. Should there be no output from the key, then the key has been fully returned at the end of the third step and the piston 124 is latched in the up position. If, however, there is output at this point, the key did not fully return to the up position after the third step, the latch did not latch, and the key failed the test. All keys on the keyboard would be tested in this manner for mechanical sticking.

In the embodiment disclosed herein, valves 200 (FIG. 2) similar to the valves in support structure 19 are also provided at the second end of the manifolds, these valves being supported by the actuator support and adjustment mechanism 50. By providing two valves to the manifolds, decreased response time of the fluid actuators 60 is achieved while maintaining the overall fluid pressure in the system at a relatively low level. For example, the fluid may be pressurized air at approximately 10 to 30 lbs. per square inch gage.

Having thus described one embodiment of the present invention, it will be understood by those skilled in the art that various alternatives and equivalents are possible using the teachings herein. The scope of the present invention is not to be limited by the present disclosure but is to be determined by the scope of the appended claims.

What is claimed is:

1. A latching fluid actuator for testing the action of keys of a keyboard comprising:

a cylinder closed at one end and a piston member sealably carried within the cylinder, the piston member including a piston rod, the rod at its one end being arranged to move downwardly to contact a key to be tested, and engagement means, first fluid inlet means for providing fluid communication through the cylinder closed end, a latch element having a first member and a second member disposed on opposite sides of the piston rod and a third member interconnecting the first and second members, a fluid responsive diaphragm member acting against one of the first or second members of the latch element, second fluid inlet means for providing fluid communication to the fluid responsive member, said second fluid inlet means providing a fluid communication independent of the fluid communication to the first fluid inlet means, spring means for applying biasing force against the other of the first or second members of the latch element, the second member being adapted to engage the piston member engagement means, the engagement means being for receiving the second member to prevent piston member displacement, and the cylinder being free of a return spring member such that the upward action of a normally operative key effectively returns the piston rod upwardly to a position where the second member is permitted to engage the engagement means.

2. An actuator as in claim 1, wherein the latch element includes an opening defined by the first member, second member and third member, the opening receiving the piston rod.

3. A latching fluid actuator for testing the action of keys of a keyboard comprising:

a cylinder closed at one end and a piston member sealably carried within the cylinder, the piston member including a piston rod, the rod at its one end being arranged to move downwardly to contact a key, and engagement means, first fluid inlet means for providing fluid communication through the cylinder closed end, a latch element having a first member and a second member disposed on opposite sides of the piston rod and a third member interconnecting the first and second members;

a fluid responsive diaphragm member acting against one of the first or second members of the latch element, second fluid inlet means for providing fluid communication to the fluid responsive member, said second fluid inlet means providing a fluid communication independent of the fluid communication to the first fluid inlet means, and spring means for applying biasing force against the other of the first or second members of the latch element, the second member being adapted to engage the piston member engagement means, the engagement means being for receiving the second member to prevent piston member displacement when said piston member is in a retractive position within the cylinder, the cylinder being free of a return spring member such that the upward action of a normally operative key effectively returns the piston upwardly to a position where the engagement means is engaged.

4. An actuator as claimed in any one of claims 1, 2 or 3, wherein the latching element and diaphragm are integrally contained at the end of the cylinder remote from the closed end.

5. An actuator apparatus for controllably and selectively actuating the keys of a keyboard-operated apparatus in response to signals from control means comprising:

a plurality of latching fluid actuators including a latch element and piston means, the piston means including a cylinder closed at one end and a piston member sealably carried within the cylinder and including a piston rod for interacting at one end with the keys of the keyboard, fluid inlet means for providing fluid communication through the cylinder closed end, the latch element having a first member and a second member disposed on opposite sides of the piston rod and a third member interconnecting the first member and the second member, spring means biasing the latch element into engagement with the piston member, the piston member including engagement means for receiving the second member to prevent piston member displacement, and a fluid responsive element acting against the first member and responsive to fluid pressure in communication with the fluid actuator for operating the latch element to disengage the second member from the engagement means, the cylinder being free of a return spring member such that the upward action of a normally operative key effectively returns the piston rod upwardly to a position where the piston rod is retractably latched.

6. A method of testing the action of a key on a keyboard comprising pressurizing a latch release fluid connector to unlatch a piston rod means; pressurizing a drive fluid connection to urge said piston rod means downwardly and the key downwardly; measuring a first electrical output from the key; depressurizing the fluid connection to allow the key to move upwardly and urge the piston rod upwardly; depressurizing a latch release fluid connection to attempt relatching of the piston rod means; repressurizing the drive fluid connection to attempt to urge the piston rod means downwardly; measuring the second output electrical signal from the key; and determining whether there is any difference in the first and second electrical outputs, a difference being indicative of return of the key to its substantially fully raised position and the piston rod means to its latched position.

* * * * *